US005830015A

United States Patent [19]

Rodrigues et al.

[11] Patent Number: 5,830,015

[45] **Date of Patent: *Nov. 3, 1998**

[54] ENHANCED PERFORMANCE DATA CONNECTOR

[75] Inventors: Julio F. Rodrigues, Collierville, Tenn.; Richard Podgalsky, Crawford, N.J.; Richard Marowsky, Collierville, Tenn.

[73] Assignee: Thomas & Betts Corporation, Memphis, Tenn.

[ * ] Notice: The term of this patent shall not extend beyond the expiration date of Pat. No. 5,376,021.

[21] Appl. No.: 636,054

[22] Filed: Apr. 22, 1996

Related U.S. Application Data

[63] Continuation of Ser. No. 362,025, Dec. 22, 1994, Pat. No. 5,509,824, which is a continuation of Ser. No. 13,857, Feb. 5, 1993.

[51] Int. Cl.[6] ..... H01R 13/648

[52] U.S. Cl. ..... 439/608; 439/108

[58] Field of Search ..... 439/607, 608, 439/609, 610, 188, 101, 108

[56] References Cited

U.S. PATENT DOCUMENTS

| | | | |
|---|---|---|---|
| 4,449,778 | 5/1984 | Lane | 439/610 |
| 4,824,383 | 4/1989 | Lemke | 439/108 |
| 4,884,981 | 12/1989 | Chandler et al. | 439/610 |
| 4,898,546 | 2/1990 | Elco et al. | 439/608 |
| 5,376,021 | 12/1994 | Rodrigues et al. | 439/608 |

*Primary Examiner*—Hien Vu
*Attorney, Agent, or Firm*—Hoffmann & Baron, LLP

[57] ABSTRACT

A shielded electrical data connector terminates a shielded multiconductor cable. The data connector includes an insulative housing having a conductive housing shield therein. A contact holding member is accommodated in the connector housing and supports a row of plural spaced electrical contacts thereon. A contact shield is supported by the contact holding member. The contact shield has a shield extension extending between at least two of the contacts so as to reduce cross-talk as between the two contacts. The contact shield is electrically commoned with the housing shield to maintain continuous electrical shielding.

13 Claims, 2 Drawing Sheets

ENHANCED PERFORMANCE DATA CONNECTOR

This is a continuation of U.S. application Ser. No. 08/362,025, filed Dec. 12, 1994, now U.S. Pat. No. 5,509, 824, which in turn is a continuation of U.S. Ser. application No. 08/013,857, filed Feb. 5, 1993.

FIELD OF THE INVENTION

The present invention relates generally to improvements in shielded electrical data connectors. More particularly, the present invention relates to a shielded electrical data connector having enhanced performance.

BACKGROUND OF THE INVENTION

The use of electrical connectors to terminate electrical cable carrying data transmission signals is well-known. Electrical connectors of this type are shown in numerous patents including U.S. Pat. No. 4,449,778, U.S. Pat. No. 4,501,459 and U.S. Pat. No. 4,619,494. Each of the connectors described in these patents includes a connector shield. Shielded connectors provide protection from electromagnetic and radio frequency interferences (EMI and RFI) which may be present in the environment.

Recently, the industry has been increasing the rate of data signal transmission along the data cable. Data rates of 100 mbps are now being achieved. These increased data rates result in an increase in the cross-talk levels between the conductors of the cable, which are terminated in the electrical connector. While the shielding provided in the above-identified data connectors is adequate for the lower transmission rates, it has been found that this shielding may not be sufficient for the increased signal rates. At high data rates, the cross-talk problem is particularly prevalent as between adjacent pairs of contacts supported in the data connector housing. Improvements in data connector shielding have been attempted. U.S. Pat. No. 5,030,115 shows an improved data connector shield overcoat. However, improvements such as this do not address cross-talk.

It is, therefore, desirable to provide an electrical connector which provides improved shielding to reduce the cross-talk between contact pairs at high data rates.

SUMMARY OF THE INVENTION

It is an object of the present invention to provide an improved electrical data connector.

It is a further object of the present invention to provide improved shielding in an electrical data connector.

It is a still further object of the present invention to provide improved shielding in a data connector so as to reduce cross talk between contacts of the connector.

In the efficient attainment of these and other objects, the present invention provides a data connector assembly including an insulative housing having a metallic housing shield therearound. A contact holding member supports a row of plural spaced electrical contacts thereon. The insulative housing accommodates the holding member therein. A contact shield is supported by the contact holding member. The contact shield has shield extensions which extend between at least two of the contacts supported on the holding member and on each side of the contact row. The contact shield is electrically commoned with the housing shield.

As more particularly described by way of the preferred embodiment herein, the contact holding member includes a pair of sidewalls bounding the row of contact and a central dividing wall extending between at least two of the contacts. The contact shield extensions extend within slots in the sidewalls of the contact holding member as well as the dividing wall.

DETAILED DESCRIPTION OF THE PREFERRED EMBODIMENTS

Figure 1:
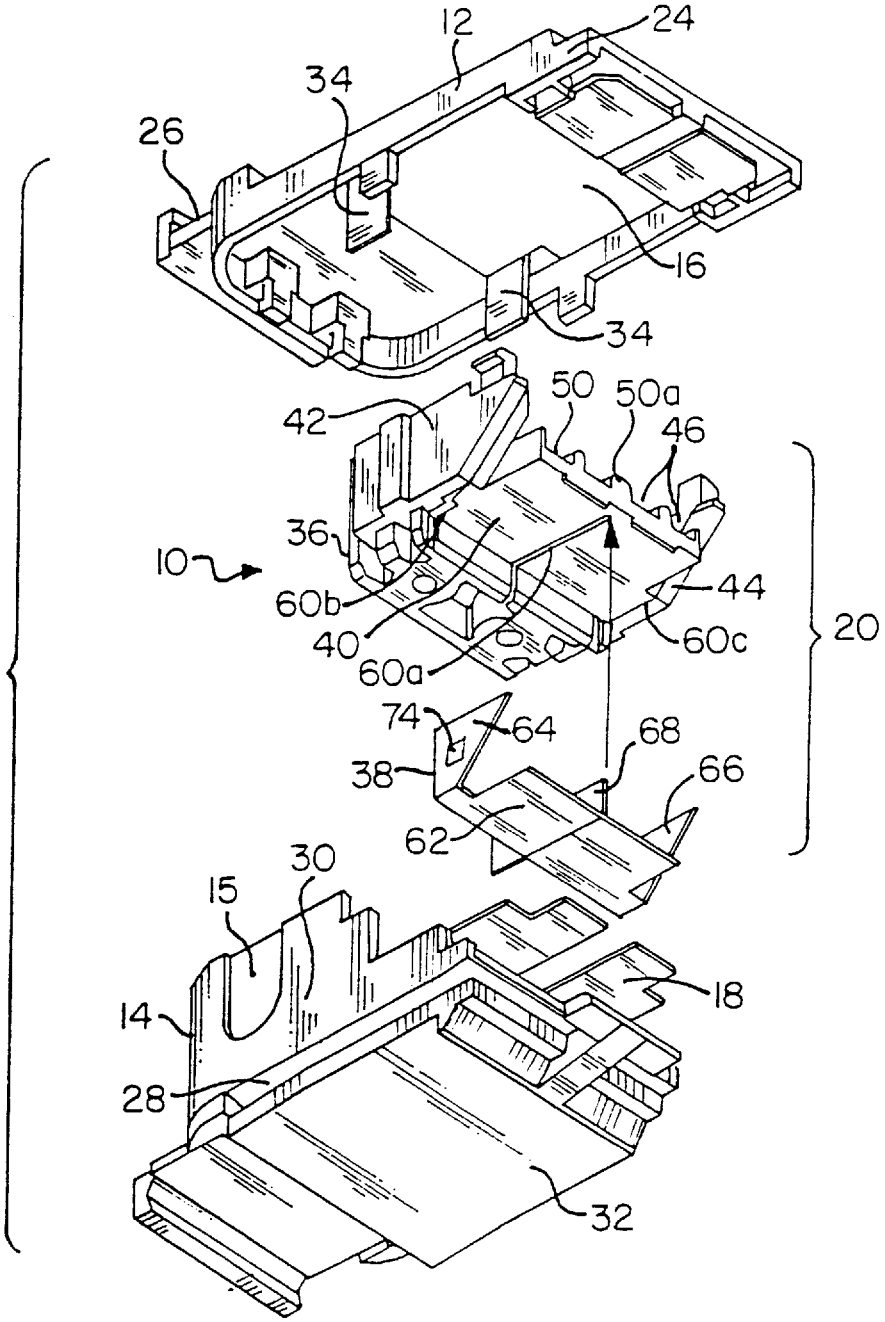
FIG. 1 shows an exploded perspective view of components of the electrical data connector assembly of the present invention.

Referring to FIG. 1, a shielded electrical data connector assembly 10 of the present invention is shown. Data connector 10 is of the type used to terminate a multiconductor shielded data cable (not shown) and is substantially similar to the connector shown in U.S. Pat. No. 4,619,494, issued Oct. 28, 1986, entitled "Shielded Electrical Connector," which is assigned the assignee of the present invention and which is incorporated by reference herein for all purposes.

Connector 10 comprises an insulative housing defined by a cover 12 and a base 14. Connector 10 also includes an upper electrically conductive shield 16, a lower electrically conductive shield 18, and a conductor termination subassembly 20, also shown in FIG. 2. Cover 12 includes an elongate generally planar lid 24 supporting a latching mechanism 26. Base 14 includes a bottom wall 28 and an upstanding sidewall 30, which partially surrounds bottom wall 28. Sidewall 30 includes one or more cable entry ports 15 for accommodating the data cable. Base 14 also includes latching mechanism 32, which in combination with latching mechanism 26 of cover 12 permits interconnection of connector 10 with another similarly constructed connector in a manner described in greater detail in the above-identified '494 patent. Upper shield 16 is a planar metallic member which substantially encompasses the lower surface of cover 12. Lower shield 18 is also a planar member which covers the upper surface of bottom wall 28 of base 14. Depending shield members 34, extending from upper shield 16, engage lower shield 18 to provide electrical continuity therebetween. The manner in which upper shield 16 and lower shield 18 effectively shields connector 10 from EMI and RFI is also more fully described in the above-identified '494 patent.

Housed between cover 12 and base 14 is conductor subassembly 20. With additional reference to FIG. 2, conductor subassembly 20 includes an insulative contact holder 36 and a contact shield 38. Contact holder 36 comprises a bottom wall 40 and two transversely spaced upstanding sidewalls 42 and 44. A plurality of spaced parallel channels 46 are provided in bottom wall 40. A transverse wall 48 of height less than the sidewalls extends across the rear of bottom wall 40. Channels 46 are defined by longitudinal dividers 50 extending upwardly from bottom wall 40 with a central divider 50*a* having a greater thickness than the other dividers.

Figure 2:
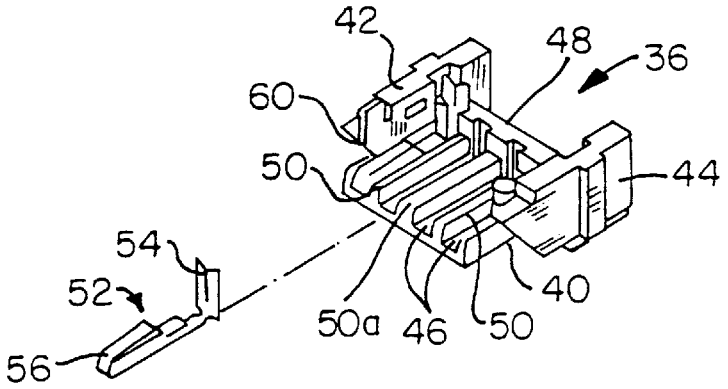
FIG. 2 shows the contact holder of the assembly of FIG. 1.

A plurality of electrical contacts 52 are supported by holder 36. Contact 52 is an elongate member formed of a suitably conductive material and includes at the other end a conductor connection portion 54, which, as shown in FIG. 2, is an insulation displacement contact portion for connection with the multiconductor cable. Contact 52 also includes at the other end a connection portion 56 for electrical connection with another similarly formed electrical contact. Contacts 52 are fixedly secured in holder 36 in respective channels 46 with dividers 50 electrically isolating each of the individual contacts 52.

In the present embodiment, four contacts 52 are supported in holder 36. These contacts 52 considered in pairs, that is two contacts of one pair being on one side of divider 50*a* and two contacts of another pair being on the other side of divider 50*a*. In order to provide for reduced cross talk as between contacts 52, especially as between each pair of contacts supported on each side of divider 50*a*, the present invention contemplates interposing a contact shield 38 within contact holder 36. Contact holder 36 is modified from that shown in the above-identified '494 patent to have a plurality of slots 60 therein. A longitudinal central slot 60*a* extends from bottom wall 40 up through longitudinal central divider 50*a* along the length thereof. A pair of elongate lateral slots 60*b* and 60*c* extend from bottom wall 40 up through sidewalls 42 and 44 respectively.

Figure 3:
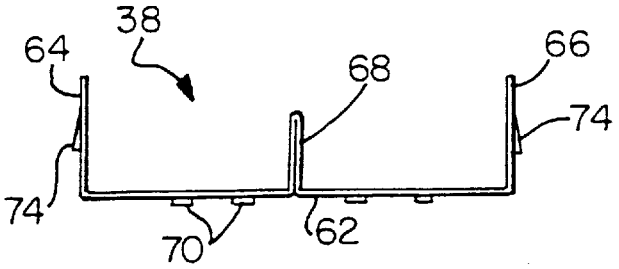
FIGS. 3, 4, and 5 show front, side and bottom views, respectively, of the improved contact shield of the assembly of FIG. 1.
Figure 4:
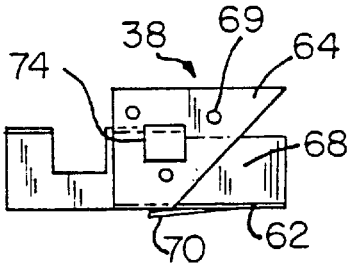
Figure 5:
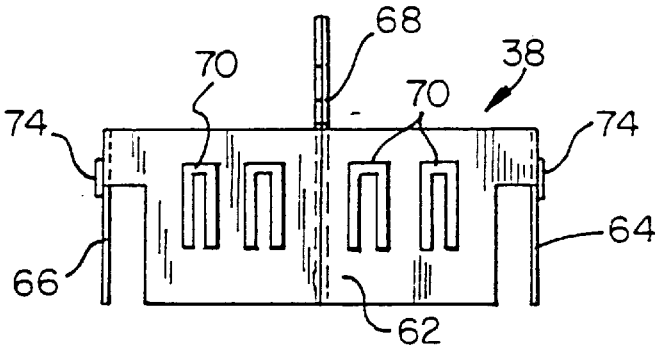

Referring additionally now to FIGS. 3 through 5, contact holder 36 is constructed to accommodate contact shield 38 therein. Shield 38 is a metallic member formed of stamped material, having a bottom planar surface 62, which is constructed to be in conformance with bottom wall 40 of holder 36 and a pair of upstanding transversely spaced side extensions 64 and 66. A planar central extension 68 extends upwardly from planar surface 62 between side extensions 64 and 66. Side extensions 64 and 66 are constructed to be received within lateral slots 60*b* and 60*c*, respectively, and central extension 68 is designed to be received within central slot 60*a* of contact holder 36. Each of side extensions 64 and 66 and central extension 68 are of sufficient height and length to span the length of elongate contacts 52 to provide cross-talk shielding for the contacts supported between dividers 50 of holder 36. Specifically, central extension 68 shields the pair of contacts 52 on one side of divider 50*a* from the pair of contacts 52 on the other side of divider 50*a*.

In order to insure that contact shield 38 is commoned with the shield of connector 10, contact shield 38 includes a plurality of electrical engagement fingers 70 thereon. Planar surface 62 of shield 38 includes four dual-beam contact fingers 70, which are in the form of cantilevered spring elements struck from the surface thereof. Dual beam contact fingers 70 extend downwardly to engage lower shield 18 of base 14 to establish electrical engagement therewith.

In addition, side extensions 64 and 66 include lances 74, which are struck outwardly from the surface thereof. Lances 74 engage sidewalls 42 and 44 within slots 60*b* and 60 to frictionally secure contact shield 38 on contact holder 36.

As can be appreciated, electrical continuity is maintained as among upper shield 16, lower shield 18, and contact shield 38. The electrically continuous shield established will not only shield the connector from external EMI and RFI, but will also provide cross-talk reduction as between pairs of contacts 52 supported within connector 10.

Various changes to the foregoing described and shown structures would now be evident to those skilled in the art. Accordingly, the particularly disclosed scope of the invention is set forth in the following claims.

We claim:

1. A data connector comprising:

an insulative housing having a base and a cover, each of said base and cover supporting a substantially planar conductive shield;

an insulative contact holding member being positioned in said insulative housing and said shield, the contact holding member including a row of plural contact receiving spaces;

a plurality of electrical contacts supported in the contact receiving spaces, each electrical contact having a connection end and a termination end; and A conductive contact shield positioned within the housing, the contact shield including a shield extension extending between at least two of said electrical contacts and extending substantially from the termination end to the interconnection end of the at least two electrical contacts, wherein the conductive contact shield is discrete and separate from the housing shield.

2. A data connector as defined in claim 1, wherein the termination end of each electrical contact includes an insulation displacement contact portion for terminating a conductor of a multiconductor cable.

3. A data connector as defined in claim 1, wherein the conductive contact shield includes a pair of side shield extensions, one side shield extension bounding each side of the row of contacts.

4. A data connector as defined in claim 1, wherein the conductive contact shield is in electrical communication with the housing shield.

5. A data connector as defined in claim 1, wherein the conductive contact shield includes a planar shield portion underlying the row of contacts and being substantially parallel to the planar conductive shield of the housing base and cover and wherein the shield extension is substantially perpendicular to the planar shield portion.

6. A data connector as defined in claim 1, wherein the contacts include two pairs of contacts and the contact shield extension extends between the two pairs of contacts.

7. A data connector comprising:

an insulative housing supporting a conductive housing shield;

an insulative contact holding member including a support member having a plurality of spaced electrical contacts thereon, said holding member being positioned within the insulative housing and said conductive housing shield; and A contact shield positioned within said contact holding member, said contact shield including a shield extension extending between at least two of said contacts, said housing shield overlying substantially the entire length of the contact shield, said conductive contact shield being discrete and separate from said housing shield, said housing shield and contact shield being in electrical communication.

8. A data connector as defined by claim 7, wherein the contact shield includes a pair of side shield extensions, one side shield extension bounding each side of the plural spaced electrical contacts.

9. A data connector as defined in claim 7, wherein the contacts include two pairs of contacts and the contact shield extension extends between the two pairs of contacts.

10. A data connector as defined by claim 7, wherein the contact shield includes a planar shield portion underlying the plural spaced contacts and wherein the shield extension is substantially perpendicular to the planar shield portions.

11. A data connector as defined by claim 7, wherein each contact includes a connection end and a termination end and the shield extension of the contact shield extends substantially from said termination end to said connection end.

12. A data connector as fined by claim 8, wherein each contact includes a connection end and a termination end and the shield extension of the contact shield extends substantially from said termination end to said connection end.

13. A data connector comprising:

an insulative housing supporting a conductive housing shield;

an insulative contact holding member being positioned in said insulative housing and said conductive housing shield and supporting a row of plural spaced electrical contacts thereon, said row of contacts being arranged generally in a plane; and a contact shield having a planar extent underlying the contacts and being generally parallel to the plane of the row of contacts, said contact shield including a central shield extension extending substantially perpendicular to the planar extent and positioned between at least two contacts in said row, said contact shield being integrally formed from a conductive material and said central shield extent having a longitudinal extent substantially extending from a connection end to a termination end of said contacts, said contact shield being discrete and separate from the housing shield and in electrical communication with the housing conductive shield.

* * * * *